US007493991B2

(12) United States Patent
Oh et al.

(10) Patent No.: US 7,493,991 B2
(45) **Date of Patent: *Feb. 24, 2009**

(54) ELECTROMAGNETIC/ULTRASONIC ROLL-CALLING/ANSWERING (EURA) SYSTEM FOR ELEVATOR POSITIONING

(75) Inventors: Jae-Hyuk Oh, Tolland, CT (US); Alan M. Finn, Hebron, CT (US); Pei-Yuan Peng, Ellington, CT (US); Norbert A. M. Hootsmans, South Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 465 days.

This patent is subject to a terminal disclaimer.

(21) Appl. No.: 10/557,088

(22) PCT Filed: May 30, 2003

(86) PCT No.: PCT/US03/16936

§ 371 (c)(1),
(2), (4) Date: Nov. 16, 2005

(87) PCT Pub. No.: WO2004/108574

PCT Pub. Date: Dec. 16, 2004

(65) Prior Publication Data

US 2006/0283670 A1 Dec. 21, 2006

(51) Int. Cl.
*B66B 1/34* (2006.01)

(52) U.S. Cl. ..... 187/394; 187/247

(58) Field of Classification Search ..... 187/247, 187/248, 391–394, 413, 414
See application file for complete search history.

(56) References Cited

U.S. PATENT DOCUMENTS

| | | | | | |
|---|---|---|---|---|---|
| 3,414,088 | A | * | 12/1968 | William et al. | 187/389 |
| 4,134,476 | A | * | 1/1979 | Zolnerovich et al. | 187/394 |
| 4,375,057 | A | * | 2/1983 | Weise et al. | 187/394 |
| 4,674,604 | A | * | 6/1987 | Williams | 187/291 |
| 4,732,238 | A | * | 3/1988 | Baumgartner | 187/317 |
| 5,223,680 | A | * | 6/1993 | Schmidt-Milkau et al. | 187/394 |
| 5,306,882 | A | * | 4/1994 | Gerwing et al. | 187/394 |
| 5,677,519 | A | * | 10/1997 | Herkel et al. | 187/291 |
| 5,682,024 | A | * | 10/1997 | Koopman et al. | 187/394 |
| 5,736,695 | A | * | 4/1998 | Hoepken | 187/394 |
| 5,831,227 | A | * | 11/1998 | Finn et al. | 187/394 |
| 5,883,345 | A | * | 3/1999 | Schonauer et al. | 187/394 |
| 5,889,239 | A | * | 3/1999 | Blackaby et al. | 187/391 |
| 6,079,521 | A | * | 6/2000 | Schonauer et al. | 187/393 |
| 6,305,503 | B1 | * | 10/2001 | Suzuki et al. | 187/393 |

FOREIGN PATENT DOCUMENTS

JP 02295866 A * 12/1990

* cited by examiner

*Primary Examiner*—Jonathan Salata
(74) *Attorney, Agent, or Firm*—Bachman & Lapointe, P.C.

(57) ABSTRACT

A positioning system for an elevator cab (37) includes transponder modules (10) having a unique ID for receiving a signal (39) and emitting an ultrasonic signal when the signal is equivalent to the unique ID with a determination of position based on the time duration of the signals.

15 Claims, 1 Drawing Sheet

ELECTROMAGNETIC/ULTRASONIC ROLL-CALLING/ANSWERING (EURA) SYSTEM FOR ELEVATOR POSITIONING

BACKGROUND OF THE INVENTION (1) Field of the Invention

The present invention relates to an apparatus, and method for so using, ultrasonic and RF signals to establish the position of a moveable platform. More specifically, the present invention relates to a method of situating transceiver and transponder modules so as to measure the position of an elevator car in operation.

(2) Description of Related Art

A Positioning Reference System (PRS) is a component of an elevator control system that provides fast and accurate position measurement of elevator car in a hoistway. Many existing PRSs are based on encoders that are attached to the elevator motor, governor, or independent sheaves. These PRSs suffer from differences between the encoder reading and the real position that is caused by slippage, rope stretch, mechanical wear in subsystems, and/or building sway. To minimize the difference, correction should be performed frequently based on some fixed and known referencing points showing the real position of landing floor and leveling-zone. A vane system, consisting of vane reader and vanes, provides these referencing points and their detection means. Considering the simple functionality of the vane system, the vane system is quite cost-inefficient since a vane, which is installed at every floor by a mechanic in the hoistway, costs $10 for material, 0.5 hour for installation, and about 0.1 hour for adjustment. Overall, one of the most significant problems in the existing PRSs is the poor performance to cost ratio.

In response to the shortcomings of existing PRSs, there has been developed Passive Ultrasonic RF-ID Systems, in short, PURIS. However, PURIS systems pose additional challenges. For example, wireless power supply through ultrasound may not be sufficient to activate the transponders. In addition, aerodynamic interference may degrade the positioning performance significantly.

Each of these problems can be technically resolved by powering the transponder with RF as in RFID systems and using 4 transponders (PURIs) instead of 2 at every doorframe.

Although these two solutions are good enough, they may cost more than is necessary since the first solution needs a customized production of a solid-state RFID system and the second almost doubles the material cost of the resultant system. Wired power can easily solve the first problem. However, it still cannot solve the second problem in the PURIS framework.

What is therefore needed, is a high-accuracy positioning means with low cost for material, installation, and maintenance.

SUMMARY OF THE INVENTION

Accordingly, it is an object of the present invention to provide an apparatus, and method for using, ultrasonic and RF signals to establish the position of a moveable platform.

In accordance with the present invention, a positioning system comprises a plurality of transponder modules each comprising a unique ID for receiving an electromagnetic signal comprising a code and emitting an ultrasonic signal when the code is equivalent to the unique ID, a transceiver module comprising at least one set of at least three ultrasonic signal receivers for emitting the at least one coded electromagnetic signal and receiving the ultrasonic signal, means for determining a duration of time between an emission of the coded electromagnetic signal and receipt of the ultrasonic signal by the at least three ultrasonic receivers, and means for determining a position of the transceiver module from the durations of time.

In accordance with the present invention, an apparatus for measuring a position of a moveable platform comprises a plurality of transponder modules comprising an RF receiver adapted to receive a coded RF signal, an ultrasonic transmitter adapted to emit an ultrasonic signal, and a computational unit, and at least one transceiver module affixed to the moveable platform comprising an RF transmitter adapted to emit a coded RF signal, a plurality of ultrasonic receivers adapted to receive an ultrasonic signal, a timing mechanism for measuring a plurality of durations between an emission of the coded RF signal and a receipt of the ultrasonic signal by the plurality of ultrasonic receivers, and a computing mechanism for processing the plurality of durations to compute the position.

In accordance with the present invention, a method for measuring a position of a moveable platform comprises the steps of depositing a plurality of transponder modules for receiving a coded RF signal and emitting an ultrasonic signal at fixed positions, depositing at least one transceiver module for emitting one coded RF signal and receiving the ultrasonic signal with a plurality of ultrasonic receivers, emitting the coded RF signal, receiving the coded RF signal and emitting an ultrasonic signal in reply thereto, receiving the ultrasonic signal with the plurality of ultrasonic receivers, measuring a plurality of durations of time between the emission of the coded RF signal and the receipt of the ultrasonic signals by the plurality of ultrasonic receivers, and determining a position of the transceiver module from the durations of time.

In further accordance with the present invention, a method for measuring a position of a moveable platform comprises the steps of affixing at least one transceiver module to the moveable platform the transceiver module comprising an RF transmitter adapted to emit a coded RF signal, a plurality of ultrasonic receivers adapted to receive an ultrasonic signal, a timing mechanism for measuring a plurality of durations between an emission of the coded RF signal and a receipt of the ultrasonic signal, and a computing mechanism for processing the plurality of durations, disposing a plurality of transponder modules each at a fixed position the transponder modules comprising an RF receiver adapted to receive a coded RF signal, an ultrasonic transmitter adapted to emit an ultrasonic signal; and a computational unit, and emitting from the transceiver module the coded RF signal for receipt by the one of the plurality of transponder modules and starting a timing mechanism, receiving the coded RF signal with one of the plurality of transponder modules and emitting an ultrasonic signal in response thereto, receiving the emitted ultrasonic signal with the plurality of ultrasonic receivers, using the timing mechanism to measure at least three durations of time between emitting the coded RF signal and receiving the ultrasonic signal by the plurality of ultrasonic receivers, and computing the position of the moveable platform using the fixed positions and the at least three measured duration of time.

DETAILED DESCRIPTION OF THE PREFERRED EMBODIMENT(S)

The present invention discloses an electromagnetic/ultrasonic roll-calling/answering (EURA) system.

The EURA system consists of multiple transponder modules, preferably one per landing, and a transceiver module attached to the elevator cab. The electromagnetic wave that will be used as an example in this invention disclosure is a Radio Frequency (RF) wave. However, other electromagnetic waves such as microwave or light can be used for the implementation of this concept. While described with respect to an elevator, the present invention is not so limited. Rather, the present invention is drawn broadly to a EURA system for use with any moveable platform.

Figure 1:
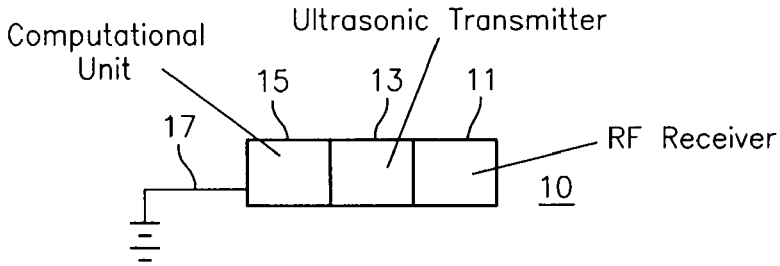
FIG. 1 A diagram of a transponder module of the present invention.

With reference to FIG. 1, there is illustrated a transponder module of the present invention. The transponder module 10 is composed of a RF receiver 11, a narrow-beam-angle ultrasonic transmitter 13, and a computational unit 15. A transponder module 10 will be pre-installed at an identical spot in each doorframe seal along an elevator hoistway as described below. The power wire 17 for the transponder is also pre-installed appropriately in the doorframe. As used herein, "pre-installation" means the installation performed outside of the hoistways. The ultrasonic transmitters 13 of the transponder modules 10 will be installed all face up or all face down. The ultrasonic sensors in the transceiver module, described below, will be reciprocal to the facing direction of the ultrasonic transmitters 13, that is, all face down or all face up. Here, we assume that the transponder module 10 faces up while the transceiver module faces down.

The RF receiver 11 receives a pre-determined frequency signal from the transceiver module, demodulates it to extract a code, and sends the code to the computational unit 15. The code is compared with the unique ID number stored in the computational unit. This unique ID can be either predetermined, learned by the transponder in a special training mode, or set by a mechanic on the spot. If the code is identical to the ID number, then the computational unit triggers the ultrasonic transmitter 13 to send out an ultrasonic signal. It is assumed here that there exists a power source for each of the transponder modules.

The distance between any two adjacent transponder modules 10 is confined within X m. This implies that one or more transponder modules 10 should be installed between any two adjacent transponder modules 10 which are apart more than X m apart. Preferably, the between-floor distances are about 3.5 m. with some exceptions such as a tall first floor or express zone. Hence, X can be set to 3.5. However, X may be any distance sufficient to provide operation of the EURA system. This parameter will be used to set another parameter for the transceiver module 10 as described below.

Figure 2:
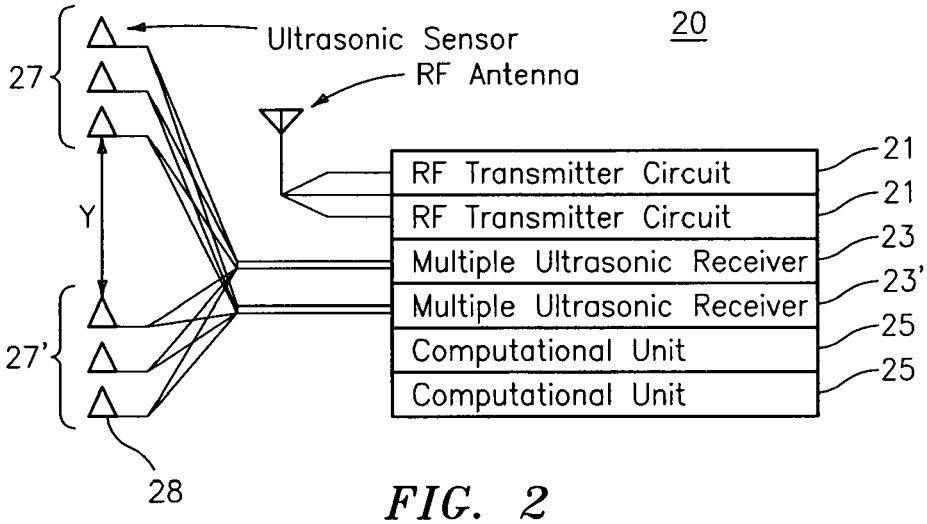
FIG. 2 A diagram of a transceiver module of the present invention.

With reference to FIG. 2, there is illustrated the transceiver module 20 of the present invention. The transceiver module 20 consists of two RF transmitter circuits 21, two multiple ultrasonic receivers 23, 23', and two separate computational units 25. The following figure depicts the components. In the preferred embodiment pictured, duplication of the circuits is for code-required redundancy, and one set of circuits is used for normal positioning and normal terminal stopping device (NTSD) function while the other set is used for emergency terminal stopping device (ETSD/ETSLD) function. Each multiple ultrasonic receiver 23, 23' includes two sets 27, 27' of three ultrasonic sensors 28, which are shared by the other receiver 23, 23'. There are, of course, other sensor redundancy designs using fewer sensors at the expense of design complexity. The distance between two adjacent sensors 28 in a set is preferably about 10 cm, but can be smaller than this. The distance between two sets, Y, is given by the following equation:

$$Y>X-Z$$

where Z is a system parameter standing for the maximum distance between the pair of transmitter and receiver. Preferably Z is set to 3 m or 2 m or 1 m. A smaller Z means a smaller measurement lag. The parameter Y satisfying the above equation guarantees that, for any moment, there exists a transponder module 10, which is located less than Z from one of two ultrasonic sensor sets 27, 27' in the transceiver module 20.

The transceiver module 20 can be pre-installed and, also, can be installed at the hoistways. Preferably, the transceiver module 20 is installed to the side of a cab 37.

Consider only one set of circuits now 27, 27'. Every predetermined time interval, for example, 10 ms, the RF transmitter 21 calls a transponder module 20. The time interval may be any length sufficient to facilitate operation of the EURA system. The calling moment is time-stamped by the computational unit 25, 25'. How to determine which transponder 10 should be called will be explained later in detail. In short, a transponder module 10, which is closest to the transceiver module 20, will be called by the transceiver module 20. This logic is valid since, except for the case of power failure, the PRS knows the approximate position of the cab 37 and the transponder modules 10.

Once the transceiver module 20 calls a transponder module 10, it waits for the arrival of an ultrasonic signal at each of the ultrasonic sensors. Each arrival at each sensor 28 will be time-stamped by the computational unit 25.

The computational unit 25 uses the time information of the calling moment and the first three earliest arrivals for the calculation of the position of the cab. This position calculation is possible since there are three unknown variables; vertical and horizontal cab position and a localized speed of sound transmission, while we have three independent equations from three ultrasonic sensors 28. Note here that there exists a deterministic time bias in the flight time, which is caused by some delays in communication and computation. In fact, one important constraint in implementing the system is to set a time bound within which successful communication is guaranteed.

Figure 3:
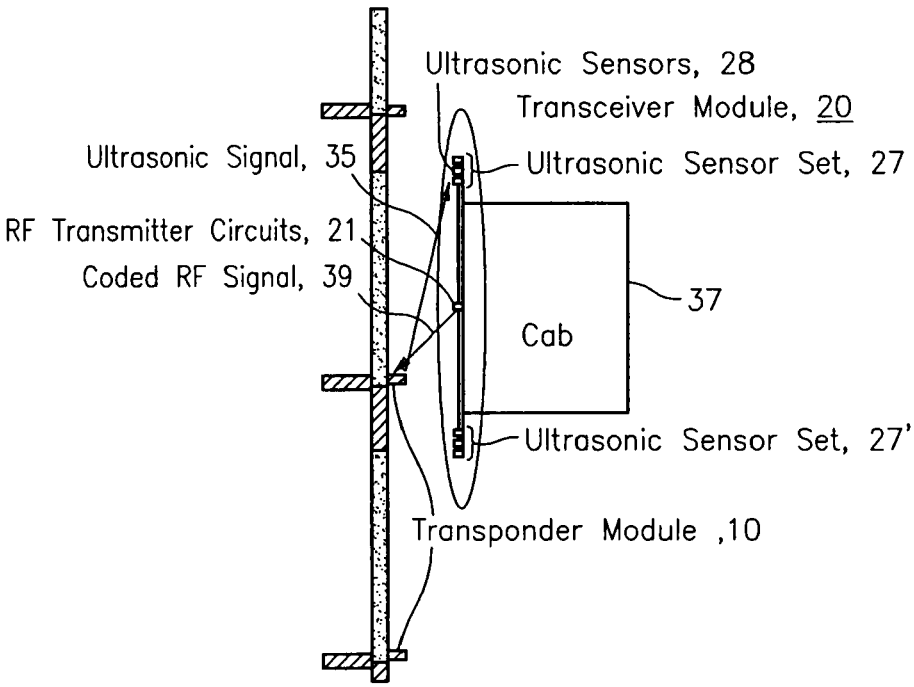
FIG. 3 A diagram of a preferred embodiment of the EURA system of the present invention.

The resultant configuration of the EURA system is depicted in detail with reference to FIG. 3. Note once again that the major differences between the PURIS and the EURA system is that the transceiver 20 knows the ID number of each transponder 10 and calls only one transponder 10 with its ID number instead of calling more than one transponder 10 simultaneously.

In normal operation, the EURA system functions as follows:

1. The transceiver module 20 knows the position of the cab 10 ms ago and the absolute position and the ID of each transponder module.

2. The transceiver module 20 calls a transponder module 10, which is closest to the center point between two sets 27, 27' of ultrasonic sensors 28 through a coded RF signal 39. The moment of calling is time-stamped.

3. Each transponder module 10 continuously listens for the transceiver module 20, decodes any incoming RF signal 39, and compares the code with its ID. If the code is identical to its ID, it triggers its ultrasonic transmitter 13 to send an ultrasonic signal.

4. The transceiver module detects and time-stamps the arrival of the ultrasonic signal 35 at each ultrasonic sensor 28.

5. By using at least three arrival time-stamps the transceiver calculates the position of the cab. The calculation may be as simple as solving 3 simultaneous equations, or may be more complex. For instance, there may be various echoes as the ultrasonic signal bounces off the cab and/or hoistway walls. Adaptive echo cancellation may be employed to reduce this type of interference.

Remark) For multiple hoistway cases, each hoistway has different set of the RF and ultrasonic signal frequencies to minimize any kind of signal interference.

For NTSD and ETSD operation, a transponder module is installed every X/2 m. By doing so, one can guarantee the measurement lag is reduced to half of the original one. In NTSD and ETSD regions, the two sets of circuits 27, 27' perform the normal positioning procedure with 5 ms initiation time difference. That is, one set 27 calls a transponder module at t=0, then the other set 27' starts its work at t=5 ms. One set is for NTSD while the other is for ETSD/ETSLD. By measuring the frequency shift caused by the Doppler-Effect, or by differentiating position measurements, the transceiver module calculates the moving speed of the cab.

For positioning in express zone, a transponder module 10 is installed at each end of an express zone for earlier detection of the ends of the express zone. The transponder module 10 installed at the bottom end includes a long-range ultrasonic transmitter. It is assumed here that its range covers the whole express zone. If not, transponder modules 10 are installed in the express zone.

Once the cab 37 enters the zone and passes the transponder module located at the end of the express zone, the transceiver 20 relies on the long-range transponder modules 10 for positioning. The transceiver module 10 needs to wait longer until receiving an ultrasound reply. After receiving one, it calls the transponder module 10 again.

To recover position after a power failure, the transceiver module 20 roll-calls the transponder modules 10 from the module located at the top of the hoistway. Since all of the ultrasonic transmitters 13 in the transponder modules 10 are assumed to face up, the transceiver module 70 cannot detect any effective ultrasound 21 until the first transponder module 10 located below the upper set 27 of the ultrasonic sensors 28 in the transceiver module 20 is called. Additional fault-tolerance to undesirable responses is possible by time gating acceptable responses.

Once the first transponder module 10 located below the upper set of the ultrasonic sensors 27 in the transceiver module 20 is called, the transceiver module 20 can recover the current position information of the cab 37.

As a result, the present invention provides high accuracy in location measurement everywhere in the hoistway, a high position update rate, low installation/adjustment cost due to minimal hoistway installation/adjustment, no maintenance cost due to simple structure and no mechanical wear, low management cost thanks to global applicability, and requires no correction run.

Although this disclosure has been presented for vertical elevator transportation, it is equally applicable to more general horizontal and vertical conveyances.

It is apparent that there has been provided in accordance with the present invention an apparatus, and method for so using, comprising ultrasonic and RF signals to establish the position of a moveable platform which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A positioning system comprising:

a plurality of transponder modules each comprising a unique ID for receiving an electromagnetic signal comprising a code and emitting an ultrasonic signal when said code is equivalent to said unique ID;

a transceiver module comprising at least one set of at least three ultrasonic signal receivers, wherein the transceiver module emits said at least one coded electromagnetic signal, and wherein said receivers receive said ultrasonic signal; and a computational unit for determining:

a duration of time between an emission of said coded electromagnetic signal and receipt of said ultrasonic signal by said at least three ultrasonic receivers; and a position of said transceiver module from said durations of time.

2. The apparatus of claim 1 wherein said at least one transceiver module is affixed to a moveable platform.

3. The apparatus of claim 2 wherein said moveable platform is an elevator.

4. The apparatus of claim 1 wherein said acoustic signal is an ultrasonic signal and said electromagnetic signal is an RF signal.

5. The apparatus of claim 1 comprising two sets of at least three ultrasonic receivers.

6. An apparatus for measuring a position of a moveable platform comprising:

a plurality of transponder modules comprising:

an RF receiver adapted to receive a coded RF signal;

an ultrasonic transmitter adapted to emit an ultrasonic signal; and a computational unit; and at least one transceiver module affixed to said moveable platform comprising:

an RF transmitter adapted to emit a coded RF signal;

a plurality of ultrasonic receivers adapted to receive an ultrasonic signal;

a timing mechanism for measuring a plurality of durations between an emission of said coded RF signal and a receipt of said ultrasonic signal by said plurality of ultrasonic receivers; and a computing mechanism for processing said plurality of durations to compute said position.

7. The apparatus of claim 6 wherein said moveable platform is adapted to move along a central axis.

8. The apparatus of claim 6 wherein said moveable platform comprises an elevator.

9. The apparatus of claim 4 wherein said at least two of said transponder modules are mounted on a plurality of a door frames.

10. A method for determining position comprising the steps of:

depositing a plurality of transponder modules for receiving a coded RF signal and emitting an ultrasonic signal at fixed positions;

depositing at least one transceiver module for emitting one coded RF signal and receiving said ultrasonic signal with a plurality of ultrasonic receivers;

emitting said coded RF signal;

receiving said coded RF signal and emitting an ultrasonic signal in reply thereto;

receiving said ultrasonic signal with said plurality of ultrasonic receivers;

measuring a plurality of durations of time between said emission of said coded RF signal and said receipt of said ultrasonic signals by said plurality of ultrasonic receivers; and determining a position of said transceiver module from said durations of time.

11. The method of claim 10 wherein said transponder module is affixed to a moving platform.

12. A method for measuring a position of a moveable platform comprising the steps of:

affixing at least one transceiver module to said moveable platform said transceiver module comprising:

an RF transmitter adapted to emit a coded RF signal;

a plurality of ultrasonic receivers adapted to receive an ultrasonic signal;

a timing mechanism for measuring a plurality of durations between an emission of said coded RF signal and a receipt of said ultrasonic signal; and a computing mechanism for processing said plurality of durations;

disposing a plurality of transponder modules each at a fixed position said transponder modules comprising:

an RF receiver adapted to receive a coded RF signal;

an ultrasonic transmitter adapted to emit an ultrasonic signal; and a computational unit;

emitting from said transceiver module said coded RF signal for receipt by said one of said plurality of transponder modules and starting a timing mechanism;

receiving said coded RF signal with one of said plurality of transponder modules and emitting an ultrasonic signal in response thereto;

receiving said emitted ultrasonic signal with said plurality of ultrasonic receivers;

using said timing mechanism to measure at least three durations of time between emitting said coded RF signal and receiving said ultrasonic signal by said plurality of ultrasonic receivers; and computing said position of said moveable platform using said fixed positions and said at least three measured duration of time.

13. The method of claim 12 wherein said disposing said plurality of transponder modules comprises the step of disposing said at least one transponder module per a floor of a building.

14. The method of claim 12 wherein said disposing said plurality of transponder modules comprises the step of disposing said at least two transponder modules in a line parallel to a central axis along which said moveable platform travels.

15. The method of claim 12 wherein said disposing at least one transceiver module affixed to said moveable platform comprises disposing said at least one transceiver module to an elevator car.

* * * * *